US006092475A

United States Patent [19]

Langer et al.

[11] Patent Number: 6,092,475

[45] Date of Patent: Jul. 25, 2000

[54] SHELF ASSEMBLY WHICH CAN BE TAKEN APART

[76] Inventors: Gabriele Langer; Marc Philipp, both of Karlstrasse 32, 70806 Kornwestheim, Germany

[21] Appl. No.: 09/127,966

[22] Filed: Aug. 3, 1998

[51] Int. Cl.[7] ..... A47B 96/14

[52] U.S. Cl. ..... 108/188; 211/186

[58] Field of Search ..... 108/149, 188, 108/150, 151, 193; 211/134, 186; 312/351

[56] References Cited

U.S. PATENT DOCUMENTS

| | | | |
|---|---|---|---|
| 1,311,976 | 8/1919 | Kroff | 108/188 |
| 3,967,327 | 7/1976 | Severson | 108/188 |
| 5,022,533 | 6/1991 | Lin | 211/1.55 |

FOREIGN PATENT DOCUMENTS

| | | | |
|---|---|---|---|
| 2638278 | 6/1977 | Germany | 108/188 |
| 923432 | 4/1963 | United Kingdom | 312/351 |
| 8810080 | 12/1988 | WIPO | 108/150 |

*Primary Examiner*—Peter M. Cuomo
*Assistant Examiner*—Gerald A. Anderson
*Attorney, Agent, or Firm*—Paul Vincent

[57] ABSTRACT

A shelf assembly is proposed which can be taken apart and which has shelves (1) and rods (2) disposed for supporting the shelves in a nearly horizontal position. Cables (3) are provided to tension the rods (2) with the shelves (1) to fix the position of the rods (2) with respect to each other and of the shelves (1) relative to the rods (2). In addition, an attachment device is provided for connecting the cables (3) to the rods (2) in a detachable manner.

8 Claims, 3 Drawing Sheets

Fig. 6
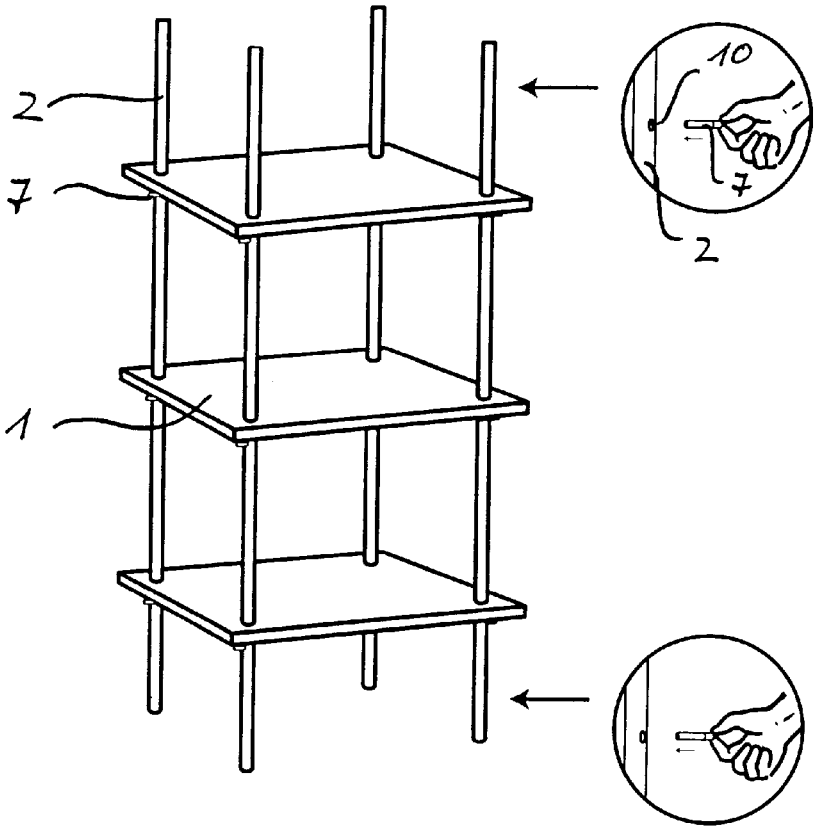
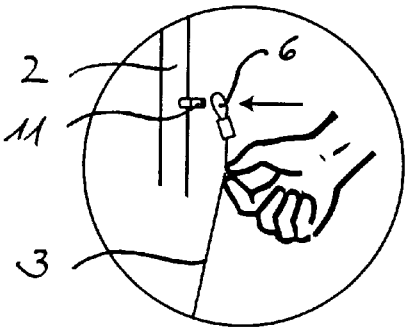
Fig. 7
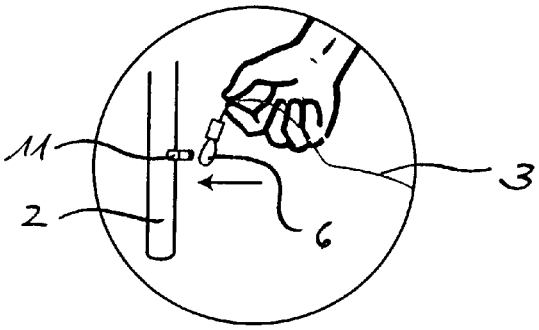
Fig. 8

SHELF ASSEMBLY WHICH CAN BE TAKEN APART

This application claims Paris Convention Priority of German patent application number 198 26 262.0 filed Jun. 15, 1998 the complete disclosure of which is hereby incorporated by reference.

BACKGROUND OF THE INVENTION

The invention concerns a shelf assembly, which can be taken apart, with rods disposed to support the shelves in a nearly horizontal fashion.

Shelf assemblies which can be taken apart are known in prior art having shelves supported by rods disposed in a nearly horizontal manner. In order to define the position of the rods with respect to each other and the position of the shelves relative to the rods, either the shelves are screwed into the rods or additional supporting elements such as support braces or tensioned cables are provided. These techniques maintain the outer appearance of the shelving assembly without having need for an additional mounting e.g. to the wall. These types of shelf assemblies have the disadvantage that they are limited in terms of their flexibility and their applications due to the additional supporting elements. For example, view of or access into the shelf is not possible from all sides. In the event that the shelves are screwed to the rods, it is difficult to dispose the shelves at differing rod positions and the rigid connections cause the shelf assembly to have a squat and cumbersome appearance.

SUMMARY OF THE INVENTION

In contrast thereto and in accordance with the invention, the shelf assembly which can be taken apart comprises cables provided to tension the rods and the shelves, the cables fixing the position of the rods with respect to each other and of the shelves relative to the rods, and an attachment device connects the cables with the rods in a detachable fashion. The invention has the advantage that cables are provided for which hold the rods together with the shelves and which fix the positions of the rods among themselves as well as the shelves relative to the rods. In addition, an attachment means is provided for connecting the cables to the rods in a detachable fashion. The length of the cables is chosen such that the rods, connected to each other via the cables, bend due to their elasticity. The rods are guided in openings in the shelves. The bending of the rods leads to the clamping of the rods in the openings in the shelves. The force that the cables exercise on the rods pushes the rods into the openings against the shelves. This pressure is sufficiently strong to hold the shelves in their positions relative to the rods even when the shelves carry additional weight. Towards this end, no additional attachment means are necessary. In particular, no additional side walls or support elements are required. In this manner, access and viewing are possible from all sides. The shelf assembly is therefore suitable for presenting and displaying objects. In addition, the rods, cables and shelves facilitate a light construction so that the shelf assembly is of low weight. Since only a few components are required to erect the shelves, assembly is simple and rapid.

In accordance with an advantageous embodiment of the invention, the upper end of each rod is connected to the lower end of the neighboring rod. In this manner, the rods are tensioned among themselves to form a stable framework for the shelves. Openings are provided in the shelves through which the rods are guided.

In accordance with an additional advantageous configuration of the invention, the attachment device comprises loops or lugs on the cables and hooks on the rods. This facilitates a rapid and simple mounting of the cables to the rods and a mutual tensioning of the rods.

In accordance with an additional advantageous configuration of the invention, those portions of the attachment device located on the rods are disposed in the end region of the rods. This facilitates bending of the rods along nearly their entire length.

In accordance with an additional advantageous configuration of the invention, openings are provided for in the rods for the acceptance of pin elements to assist in assembly. When the shelves are assembled from the individual components, the shelves can initially be fixed at the desired height on the rods with the assistance of the pin elements. The rods are subsequently tensioned via the cables to thereby fix the shelves at their predetermined positions on the rods. The pin elements can subsequently be removed from the openings, since the shelves are then held by the rods and the cables alone. It is also, however, possible to leave the pin elements in the openings. Since the pin elements do not need to support any weight, they can be small in size and are not noticeable.

In accordance with an additional advantageous configuration of the invention, the rods have a rounded cross section. This type of rod is suited for bending without the danger of folding or crimping.

In accordance with an additional advantageous configuration of the invention, the shelves are rectangular. Round shelves or shelves having an arbitrary shape are however also possible.

In accordance with an additional advantageous configuration of the invention, the shelves have openings for accepting the rods. If, for example, round rods are used, the openings advantageously also have a round cross section which however is somewhat larger than the cross section of the rods. In this manner, a clamping of the rods in the openings is facilitated. Instead of these openings, special openings for the rods can also be located on the outer sides of the shelves.

In accordance with an additional advantageous embodiment of the invention, the rods are made from aluminum. This material, compared to others, has the advantage of having low weight, being easily worked, and having the necessary intrinsic elasticity needed for tensioning the rods.

In accordance with an additional advantageous configuration of the invention, the shelves are made from plastic. Plastic is light weight and is easy to work. It also facilitates a plurality of different appearances. In addition to plastic, wood, glass or metal can also be used as material for the shelves.

Further advantages and advantageous configurations of the invention can be extracted from the subsequent description, the drawing and the claims.

BRIEF DESCRIPTION OF THE DRAWING

An embodiment of the invention is shown in the drawing and further described below.

FIGS. 3 through 8 show the individual steps for assembling the shelf assembly of FIG. 1.

DESCRIPTION OF THE PREFERRED EMBODIMENT

Figure 1:
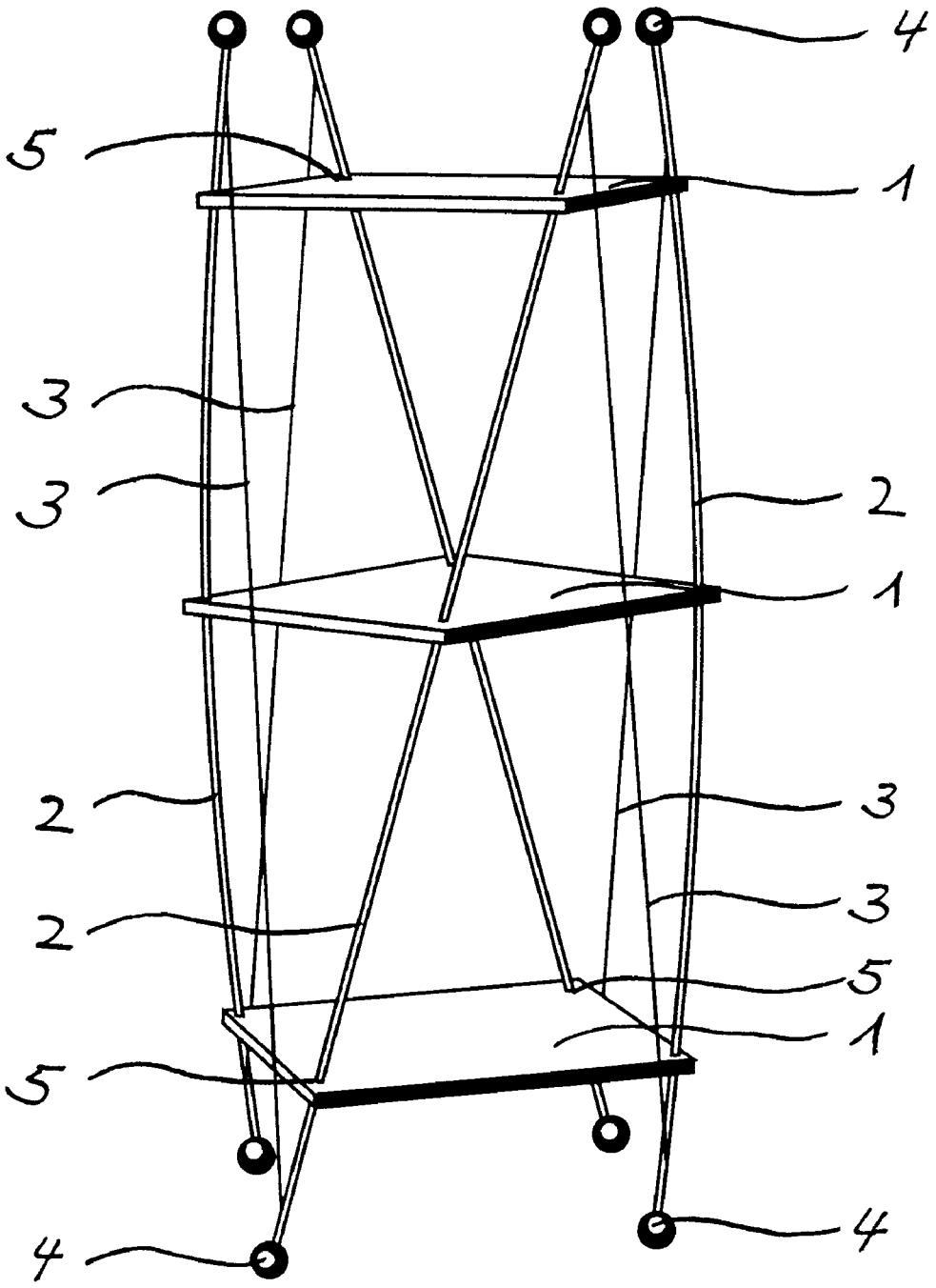
FIG. 1 shows a front view of a shelf assembly which can be taken apart.

A shelf assembly 1 which can be taken apart is shown in FIG. 1 consisting essentially of shelves 1 and rods 2. The upper end of each rod is connected via cable 3 to the lower end of the neighboring rod using an attachment device (not recognizable in this particular drawing). The length of the cable is chosen in such a fashion that the rods bend when tensioned with the cables. The rectangular shelves 1 have round openings 5 in their corners. The rods 2 are inserted through these openings 5. The ends of the rods 2 are equipped with balls 4 to prevent scratching of the floor by the rods 2 and to prevent injury by the upper ends of the rods 2.

Figure 2:
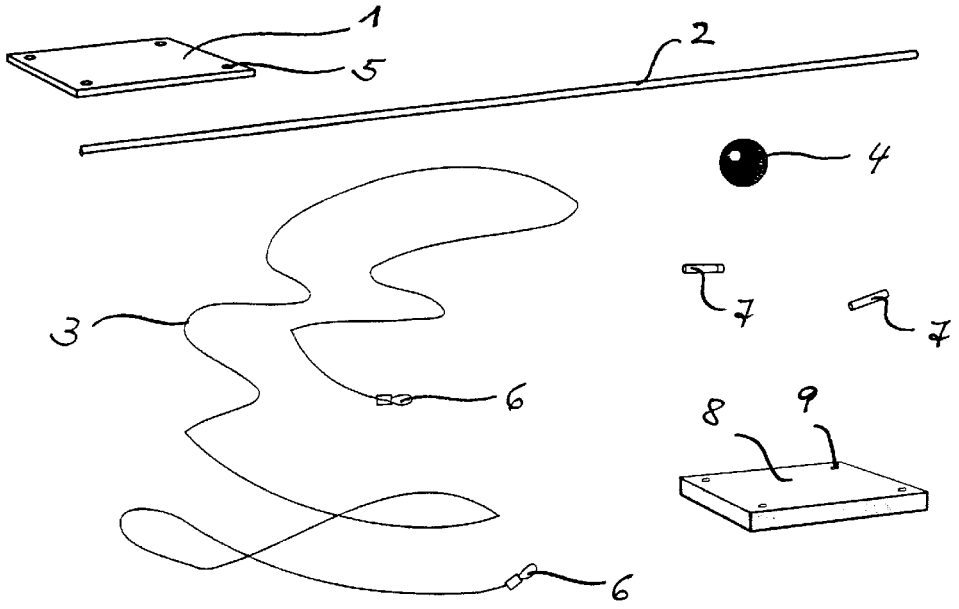
FIG. 2 shows the individual components of the shelf assembly of FIG. 1.
Figure 3:
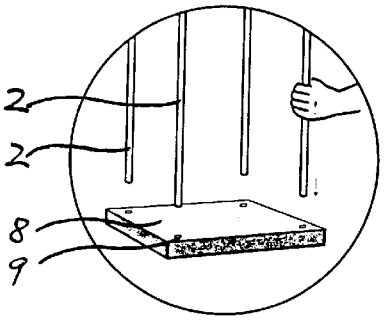
Figure 4:
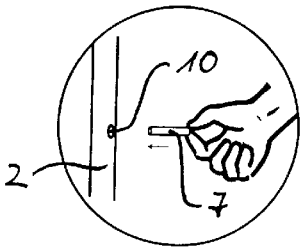

The shelf assembly which can be taken apart comprises the individual components shown in FIG. 2. These include shelves 1 having openings 5, rods 2, cables 3 and balls 4. The upper ends of the cables 3 have loops 6 for attachment to the rods 2. Additional pins 7 can be used to assist assembly and an assembly plate 8 can be provided for having fitted holes 9.

Figure 5:
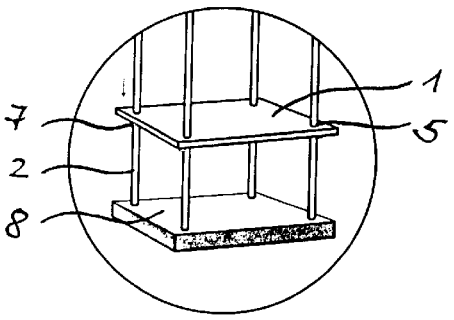

The steps necessary for construction of the shelf assembly are shown in FIGS. 3 through 8. In accordance with FIG. 3, the rods 2 are initially brought into a position at which the shelves 1 can be disposed on the rods 2. An assembly plate 8 having fitted holes 9 can thereby be used to assist this assembly. The fitted holes 9 have a diameter adapted to insert and secure the rods 2. In accordance with FIG. 4, the pins 6 are then inserted into openings 10 in the rods 2 at a position at which the lowermost shelf is to be disposed. The shelf 1 can then, as shown in FIG. 5, be guided with its openings 5 over the rod 2. In accordance with FIG. 6, the remaining shelves 1 are assembled in the same manner. Subsequent thereto and in accordance with FIGS. 7 and 8, the cables 3 are hung with their loops 6 on the pins 1 disposed at the ends of neighboring rods 2. The lengths of the cables 3 are chosen in such a fashion that the rods 2 are bent as shown in FIG. 1 after attachment of the cables 3. The balls 4 are then mounted on the ends of the rods 2.

All the features mentioned in the description, the following claims as well as those shown in the drawing can be important to the invention individually or collectively in arbitrary combination.

List of reference numbers

1 shelf
2 rod
3 cable
4 ball
5 opening
6 loop
7 pin
8 assembly plate
9 fitted holes
10 opening
11 pin

I claim:

1. A shelf structure comprising:

flexible rods, said rods substantially straight in a disassembled state of the shelf structure and curved in an assembled state of the shelf structure;

shelves disposed for support by said rods in substantially horizontal positions, said shelves having openings in edge regions thereof through which said rods pass;

cables for tensioning said rods and said shelves, said cables loading and curving said rods in the assembled state of the shelf structure for fixing a position of said rods relative to one another, and for fixing said horizontal positions of said shelves, wherein an upper end of said rods is connected by means of said cables to a lower end of a neighboring rod; and attachment members cooperating with said rods and said cables to connect said rods with said cables in a detachable fashion.

2. The shelf assembly of claim 1, wherein said shelves consist essentially of plastic.

3. The shelf assembly of claim 1, wherein said attachment member comprises one of loop and lugs on said cables and one of hooks and pins on said rods.

4. The shelf assembly of claim 1, wherein said members cooperate with said rods in end regions of said rods.

5. The shelf assembly of claim 1, wherein said rods have openings and further comprising pin elements engaging said openings to assist construction of the shelf assembly.

6. The shelf assembly of claim 1, wherein said rods have a round cross section.

7. The shelf assembly of claim 1, wherein said shelves are rectangular.

8. The shelf assembly of claim 1, wherein said rods consist essentially of aluminum.

* * * * *